US007842346B1

(12) United States Patent
Weiner

(10) Patent No.: US 7,842,346 B1
(45) **Date of Patent: *Nov. 30, 2010**

(54) FRAMED CARPET TILE

(75) Inventor: Robert S. Weiner, Dalton, GA (US)

(73) Assignee: Product Concepts Residential, L.L.C., Dalton, GA (US)

( * ) Notice: Subject to any disclaimer, the term of this patent is extended or adjusted under 35 U.S.C. 154(b) by 379 days.

This patent is subject to a terminal disclaimer.

(21) Appl. No.: 11/709,366

(22) Filed: Feb. 22, 2007

(51) Int. Cl.
*B05D 3/12* (2006.01)

(52) U.S. Cl. ..... 427/264; 427/261; 427/271

(58) Field of Classification Search ..... 427/261, 427/264, 271

See application file for complete search history.

(56) References Cited

U.S. PATENT DOCUMENTS 4,443,505 A * 4/1984 Ehrenfeld, Jr. ..... 428/89
4,629,858 A * 12/1986 Kyle ..... 219/121.69
4,766,745 A * 8/1988 Johnston et al. ..... 68/200
7,374,808 B2 * 5/2008 Sellman et al. ..... 428/94
2002/0071930 A1 * 6/2002 Oakey et al. ..... 428/85
2003/0183054 A1 * 10/2003 Becan et al. ..... 83/13

* cited by examiner

*Primary Examiner*—Frederick J Parker
(74) *Attorney, Agent, or Firm*—Stephen J. Stark; Miller & Martin PLLC

(57) ABSTRACT

A method of producing a framed carpet tile may include providing a carpet tile in accordance with the prior art techniques and then treating the carpet tile in one of various manners to provide a frame internal to side edges of the carpet tile. The treatment can include tip shearing side portions relative to an internal portion to provide at least one discontinuity, dripping colors to provide a frame, carving, burning, or otherwise providing a frame internal to the side edges of the carpet tile in various disclosed embodiments.

17 Claims, 1 Drawing Sheet

PRIOR ART

FRAMED CARPET TILE

FIELD OF THE INVENTION

The present invention relates to a carpet tile and a method of its production wherein a carpet tile is configured to have a framed border and more particularly to a framed carpet tile and method of its production wherein the framed appearance is provided by at least one of tip shearing, cutting, burning, coloring or otherwise providing the appearance of a frame clearly defined internal to the boundary edges of the carpet tile.

DESCRIPTION OF RELATED ART

Carpet tile has been made for many years by many different companies. In making carpet tile, carpet tile is made as carpet and then cut with a press to a specific dimension to provide carpet tiles. The edges are then normally trimmed substantially perpendicularly to an upper face of the carpet tile and the tile is then ready for distribution and installation. While many designs have been created over the years by various manufacturers, the applicant is unaware of carpet tile treatment methods after cutting the tiles apart from treating edges to attempt to ensure that no strands remain after the die cut process which may otherwise leave a somewhat unattractive appearance. More specifically, the applicant is unaware of any manufacturer that treats upper surfaces of carpet or cut tile to provide aesthetically pleasing designs with a frame distinguishing side portions from internal portions after the tufting process.

Accordingly, a new method of treating carpet and carpet tile is perceived to be advantageous over the prior art in order to provide new designs and configurations to the marketplace.

SUMMARY OF THE INVENTION

It is an object of the present invention to provide an improved carpet tile construction and method of its manufacture.

It is another object of at least some embodiments of the present invention to provide a method of tip shearing and/or carving at least a frame into a carpet tube cut into a carpet tile or carpet tile in at least one presently preferred embodiment of the present invention.

It is another object of at least some embodiments of the present invention to provide a frame in the shape of a rectangle internal to the edges of the carpet tile.

In accordance with the presently preferred embodiment of the present invention a carpet tile before or after having been cut into a tile is preferably tip sheared to provide an internal portion in the shape of a rectangle differentiating selected lower cut pile (side portions) from the uncut pile (in internal portions) separated by a discontinuity. The tip shearing process stops at the discontinuity which provides a visible line which forms an image of at least a portion of a frame. Other methods of creating the illusion of a frame can include carving, burning, or otherwise defining internal rectangle by treating side portions. Furthermore, by dripping and/or overdying just a frame portion other methods of creating a frame could also be provided. When utilized with other similarly framed tiles, a series of rectangular portions containing the then crisscrossing lines of at least one and possibly two thicknesses are provided thereby providing an additional effect which heretofore is not believed to have been done in the prior art.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
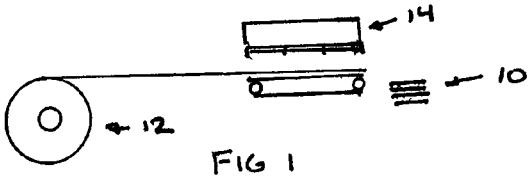
FIG. 1 is a diagrammic representation of a prior art method of cutting carpet tiles from a roll of carpet.

FIG. 1 shows a prior art diagrammic representation of a method of making carpet tiles 10 as would be known by one of ordinary skill in the art. Carpet from a roll 12 is directed to a die 14 where individual carpet tiles are produced by cutting. In the prior art, trimming edges with an edger to attempt to remove loose yarn was performed, but there was not believed to be a further effort to tip shear or otherwise treat upper portions of carpet tiles 10 once cut with the die 14.

The applicant has developed a manufacturing process 20 from which carpet tiles 10 such as carpet tiles 10 can be placed at entry 22 and directed towards a first station 24 which is illustrated treating upper surfaces one of the four sides 26 of carpet tile 28 and it proceeds through the process 20. Specifically, instead of being located to treat an edge of the carpet tile edger 30, an edger 32 or other treatment apparatus has been turned 90 degrees relative to edger 30. In this manner edger 32 effectively tip shears an outer or side portion 34 seen in FIG. 3A. Edger 30 then edges the side as has been known in the prior art which potentially removes strands of yarn but does not tip shear or otherwise treat an upper surface of the carpet internal to edge 36 as is contemplated by the presently preferred embodiment.

Figure 2:
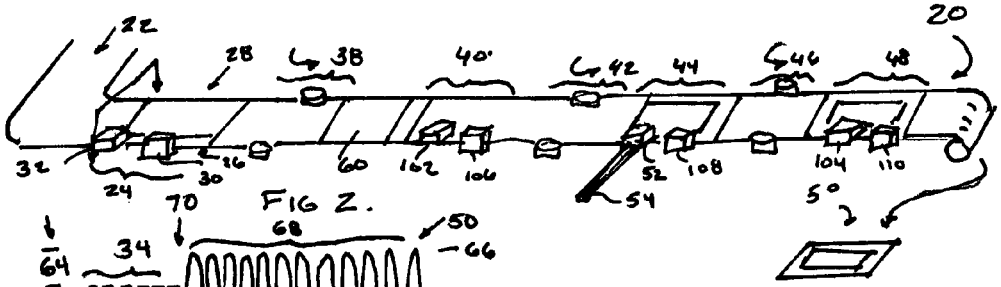
FIG. 2 is a top perspective view of a process of producing framed carpet tiles in accordance with a presently preferred embodiment of the present invention.

The carpet proceeds from the first station 24 to the first turning station 38 which turns the carpet tile 28 ninety degrees to the position shown in the first station 24 as it is fed into the second treatment station 40 where a second side portion is treated. The tile then proceeds to a second turning station 42 then to a third treatment station 44 then to a third turning station 46 and to a fourth treatment station 48 before being deposited as a framed carpet tile 50 as illustrated in FIG. 2. The third treatment station 44 shows an alternatively preferred feature relative to the other three cutting stations 24,40, 48 in that the cutter 52 is located on a slide 54 so that it can slide in and out to create various effects in the frame such as scalloped edges 56 shown in FIG. 6 or even points 58 or other features as would be desired. It also provides for adjustable thicknesses of side portions 34 and/or desired placements of frame 70 relative to carpet tile perimeter 102. Although only the third treatment station 44 is shown having this capability, those of ordinary skill would know all the treatment stations 24,40,44,48 could have this capability in other embodiments.

Additionally, although four separate cutting stations 24,40, 44,48 are illustrated as would be understood by one of ordinary skill in the art, it may be possible to have two stations operate at the same time such as cutting parallel side portions at the same time (i.e., opposing sides). Furthermore, in other manufacturing practices, it may be possible to have one or more treatment stations perform all of the desired treatments in one or more steps. The applicant has found that the process 20 illustrated has been found to be a particularly attractive way of producing an attractive framed carpet tile 50.

Figure 3A:
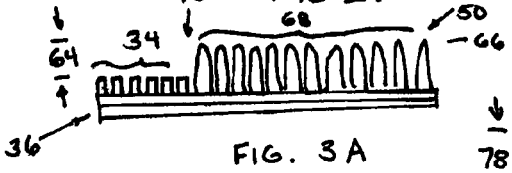
FIG. 3A is a cross-sectional view taken along line A-A of FIG. 2.
Figure 3B:
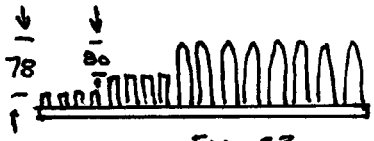
FIG. 3B is a cross-sectional view taken along line A-A of an alternative embodiment of FIG. 2.
Figure 4A:
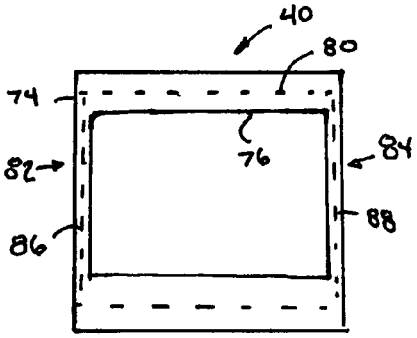
FIG. 4A is a top plan view of the embodiment of FIG. 3B.
Figure 4B:
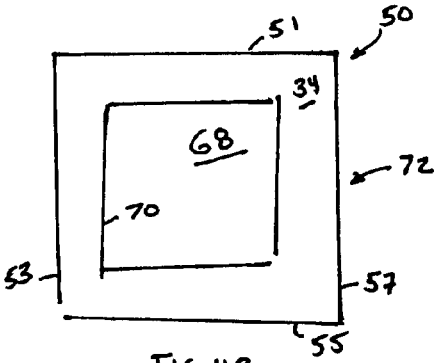
FIG. 4B is a top plan view of the embodiment of FIG. 3A.

As one can see from FIG. 3A, which reflects the cross section A-A in FIG. 2 of a carpet tile 28 as it is proceeding through the process 20, the cutter 32 cuts side portion 34 to a depth 64 lower than an elevation 66 of uncut portion 68 thereby providing a noticeable separation 70 forming a portion of a frame intermediate the side portion 64 and the interior portion 68 (it will be understood that other portions of the interior portion 68 will be treated through the process 20). This separation 70 can be better seen as interior parallel lines in FIG. 4B which define a rectangle to provide a framed tile 50 as shown in FIG. 2, 3A and 4B which in the preferred embodiment is shown in a square internal to and centrally disposed relative to external square design of the perimeter 72 of the carpet tile 50 shown in FIG. 4B. The perimeter of carpet tile 50 has first, second, third and fourth edges 51,53,55,57. The alternate embodiment shown in FIG. 4A has a perimeter 74 which is identical to that of perimeter 72 but can be of any other shape as carpet tiles are known to be produced. The internal frame perimeter 76 is rectangular but not square due to a difference in the thickness of side portions 34 as cut during the process 20. Additionally, as shown in FIGS. 4A and 3B, more than one elevation differential illustrated as first depth 78 and second depth 80 can provide a second frame perimeter 80 or even just separate line 80 which may not be a compete perimeter but may instead proceed from first edge 82 to second edge 84 such as if segments 86 and 88 are not cut to first depth 78 as would be understood by one of ordinary skill in the art. This could add even further additional effects.

Figure 6:
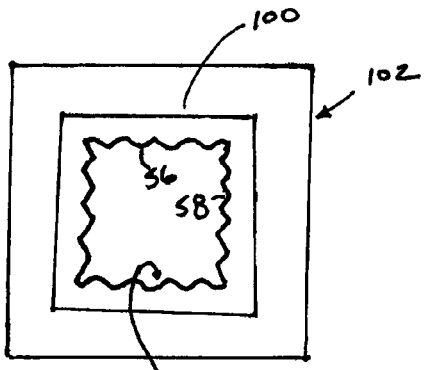
FIG. 6 is a top plan view of another alternatively preferred carpet tile embodiment.

It may be important for one of ordinary skill in the art to remember that a design has likely been tufted into the carpet tiles 50,90 during the tufting process and/or over dyed either before the process 20 or after so that the effect of creating at least a portion of the internal frame designed by perimeter 70 and 76 as well as 56 and 58 in the embodiment of FIG. 6 is believed to add dramatic effects than previously performed methods.

Figure 5:
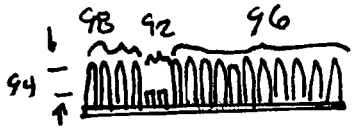
FIG. 5 is a cross-sectional view taken along line A-A of an alternatively preferred embodiment.

FIG. 5 shows a cross-sectional view of another embodiment which could be similar to that illustrated in 4B where a portion 92 is cut, carved, burned or otherwise provided a depth 94 into the carpet to distinguish section 92 from adjacent sections 96 and 98. In addition to cutting and carving, other frames may be provided in other embodiments in conjunction with removal of carpet as has been described above or with coloring by dripping or otherwise providing a coloration of a post treatment after cutting the tiles 10 in a new manner that has not believed to have been previously performed in the prior art. Discontinuity can result from post tufting coloring, carving, burning, cutting, etc., to create a visible discernment from interior portion 68 and at least a portion of side portion 34.

FIG. 6 shows an internal perimeter 59 similar to perimeters 70,76 in that which would be defined by segments such as 56 and 58. This perimeter 59 is not parallel to edges like 51,53, 55,37. Perimeter 59 could be provided as could be shown in FIG. 2 at third station 44 or otherwise to provide a non-linear treatment to side portions to provide this or other frame types. Furthermore, although the internal perimeter defined by 56 and 58 is not linear, it is possible that a second perimeter 100 could be created which is (or is not) linear in conjunction with the non-linear internal perimeters defined by segments 56,58 or others.

Frames such as looking at FIG. 4B could include the entire side portion 34 as well as a discontinuity 70. In other embodiments it may just include the discontinuity 70 and/or other portions such as the cut portion 92 carved in FIG. 5 which may be cut, burned, or otherwise provided. In yet other embodiments, still other frames may further distinguish internal portion 68 relative to side portions 34 or portion side portions 34 as would be understood in the art. Frames as here defined do not include tufted differences such as if a square pattern were tufted internal to a side portion such as with high and low loops as technology exists to be able to provide that as a design. Furthermore, frames may be provided prior to cutting into tile such as by carving or tip shearing the side portions 34 relative to non-tip sheared internal portions 68 and then cutting into carpet tile in other embodiments.

In the presently preferred embodiment, cutters such as shown at 32,102,52 and 104 are utilized to provide the side portion 34 relative to interior portions 68. The applicant has used a cutting head which is about 2 to 3 inches across which terminates at a sharp cut at junction 70 relative to uncut portion 68 as shown in FIG. 3A. Other embodiments may utilize other structures for treatment stations including carvers, burners, applicators, etc., as would be known by those of ordinary skill in the art. The cutters 32,102,52 and 104 are edgers such as edger 30,106,108 and 110 turned 90 degrees to the normal positioning used to trim loose unkempt yarns from edges 51,53,55,57 and not the upper surface of the carpet tile 50.

By providing this method of treating carpet tiles, new and exciting textures and designs are believed to be available to the market which have not previously been provided.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of manufacturing a framed carpet tile comprising:

providing a carpet tile tufted to at least one height with first, second third and fourth side edges forming a square perimeter, said carpet tile having an upper surface; and then treating the upper surface of the carpet tile to provide a frame internal to the square perimeter extending from the sides internal to the square perimeter thereby defining the frame relative to an internal portion distinguished from the frame; wherein the tile is directed to a first treatment station, and treating at least a first side, rotating the tile 90° and then treating at least a second side at a second treatment station thereby providing the frame through the treatment process.

2. The method of claim 1 wherein the step of treating the side portions of the upper surface further comprises cutting at least one of the frame and the side portions relative to the internal portion.

3. The method of claim 2 wherein the side portions are tip sheared to at least one discontinuity relative to the internal portion.

4. The method of claim 3 wherein the frame has four sides and forms a rectangle.

5. The method of claim 4 wherein the frame is a square concentrically disposed relative to the square perimeter of the carpet tile.

6. The method of claim 2 wherein the frame is carved into an upper surface of the carpet tile.

7. The method of claim 2 wherein the frame is burned into the upper surface.

8. The method of claim 3 wherein through the treatment step the frame has at least three widths relative to a nearest of the first, second, third and fourth edge.

9. The method of claim 2 further comprising the step of turning the carpet tile ninety degrees and treating a third side portion after treating the second side portion.

10. The method of claim 9 further comprising the step of turning the carpet tile ninety degrees and treating a fourth side portion after treating the third side portion.

11. The method of claim 10 wherein the treating of the third and fourth side portions occurs at respective third and fourth treatment stations.

12. The method of claim 1 further comprising the step of edging the first, second, third and fourth side edges with an edger.

13. A method of manufacturing a framed carpet tile comprising:

providing a carpet tufted to at least one height with an upper surface;

cutting carpet tile from the carpet defined by first, second third and fourth side edges forming a rectangular perimeter; and treating selected portions of the upper surface of the carpet to provide a frame internal to the rectangular perimeter of the carpet tile with an internal portion distinguishably treated relative to the at least one of frame and the treated selected portions which are side portions of the upper surface of the carpet tile with the carpet directed through a first treatment station treating at least a first side, rotated 90° and directed through a second treatment station treating at least a second side with the frame formed at the treatment stations.

14. The method of claim 13 wherein the carpet tile cut from the carpet is cut into squares.

15. The method of claim 13 wherein the carpet tile is cut from the carpet prior to treating the side portions.

16. The method of claim 13 wherein step of treating selected portions of the upper surface of the carpet include cutting selected portions relative to unselected portions thereby providing an elevational discontinuity at the interface of the selected and unselected portions which at least assists in defining at least a portion of the frame.

17. The method of claim 16 wherein the frame defines a square concentrically disposed relative to the perimeter of the carpet tile.

* * * * *